US007406900B1

(12) United States Patent
Hsieh

(10) Patent No.: US 7,406,900 B1
(45) Date of Patent: Aug. 5, 2008

(54) TENSION ALERT HAND TOOL

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/799,479

(22) Filed: May 2, 2007

(51) Int. Cl.
*B25B 23/144* (2006.01)
*B25B 23/157* (2006.01)

(52) U.S. Cl. ..... 81/479; 81/475

(58) Field of Classification Search ..... 81/479, 81/467, 475, 476, 483, 473
See application file for complete search history.

(56) References Cited

U.S. PATENT DOCUMENTS 2,442,359 A * 6/1948 Hattan ..... 81/479
2,512,032 A * 6/1950 Mellert ..... 81/479
4,517,865 A * 5/1985 Huang ..... 81/475
6,487,943 B1 * 12/2002 Jansson et al. ..... 81/475
6,526,853 B2 * 3/2003 Jenkins ..... 81/479
7,093,522 B2 * 8/2006 Guy et al. ..... 81/479

* cited by examiner

*Primary Examiner*—Hadi Shakeri

(57) ABSTRACT

A tension alert hand tool comprises a driving portion being installed with a buckling unit; the buckling unit being installed with an elastic unit; a handle being formed with a receiving groove for receiving the buckling unit and the elastic unit; a surface of the handle being formed with an through hole; and a tension alarm device having a sensor switch and an alarm unit; the sensor switch being installed in the receiving groove; the alarm unit being installed in the through hole of the handle; the sensor switch being conductive to the alarm unit; when the sensor switch is touched by the buckling unit, the sensor switch will actuate the alarm unit to light up. The tool is an opener or a spanner. The buckling unit includes an upper teethed block and a lower teethed block; and the upper teethed block is movable along the lower teethed block.

6 Claims, 4 Drawing Sheets

TENSION ALERT HAND TOOL

FIELD OF THE INVENTION

The present invention relates to hand tools, and particularly to a tension alert hand tool with the function of alerting the user that the tension applied to the screw unit has been over a predetermined value by emitting light so as to prevent the screw unit from damage by an over large tension.

BACKGROUND OF THE INVENTION

The one prior art tension alert tool has one end being an opening head. Another end of the driving portion is formed as a buckling unit. The buckling unit is formed by an upper teethed block and a lower teethed block. The upper teethed block is engageable to and bidirectionally moveable through the lower teethed block. An elastic unit encloses the driving portion and is installed above the buckling unit. The elastic unit is a spring. The handle is formed with a receiving groove for receiving the buckling unit and the elastic unit of the driving portion. The buckling unit will compress the elastic unit.

In operation, when the opener of the present invention is used to screw an object so that the driving portion rotates and the elastic unit rotates therewith. When the twisting force to the screw unit has achieved to an upper limit value, the elastic unit will release the engagement of the upper teethed block and lower teethed block so that the upper teethed block will move through the lower teethed block. The user determines whether the tension applied to a screw unit is overlarge by hearing the collision voice between the upper teethed block and lower teethed block so as to determine whether it is necessary to stop the operation.

However in this prior art, the sense of the over tension is determined by the touch feeling of the user, if the user has no precise touch feeling, he (or she) can not find that the applied tension is too large and is necessary to stop of the operation, as a result, an overlarge force is applied so as to destroy the structure and engagement of the upper teethed block and lower teethed block. For a long time, the setting value of the tension will change so as to lose the precision in operation.

Furthermore, in the prior art, the worker determines the over tension state by hearing the collision between the upper teethed block and lower teethed block, however in a noisy environment, it is often that the user can not hear the voice of collision.

SUMMARY OF THE INVENTION

Accordingly, the primary object of the present invention is to provide a tension alert hand tool with the function of alerting the user that the tension applied to the screw unit has been over a predetermined value by emitting light so as to prevent the screw unit from damage by an over large tension.

To achieve above objects, the present invention provides a tension alert hand tool, comprising: a driving portion being installed with a buckling unit; the buckling unit being installed with an elastic unit; a handle being formed with a receiving groove for receiving the buckling unit and the elastic unit; a surface of the handle being formed with an through hole; and a tension alarm device having a sensor switch and an alarm unit; the sensor switch being installed in the receiving groove of the handle; the alarm unit being installed in the through hole of the handle; the sensor switch being conductive to the alarm unit; when the sensor switch is touched by the buckling unit, the sensor switch will actuate the alarm unit to light up. The tool is an opener or a spanner. The buckling unit includes an upper teethed block and a lower teethed block; the upper teethed block is movable along the lower teethed block. A cap covers upon an upper opening of the handle; the driving portion passes through the cap; the cap and the buckling unit will compress the elastic unit. The alarm unit is a bulb or a light emitting diode device.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
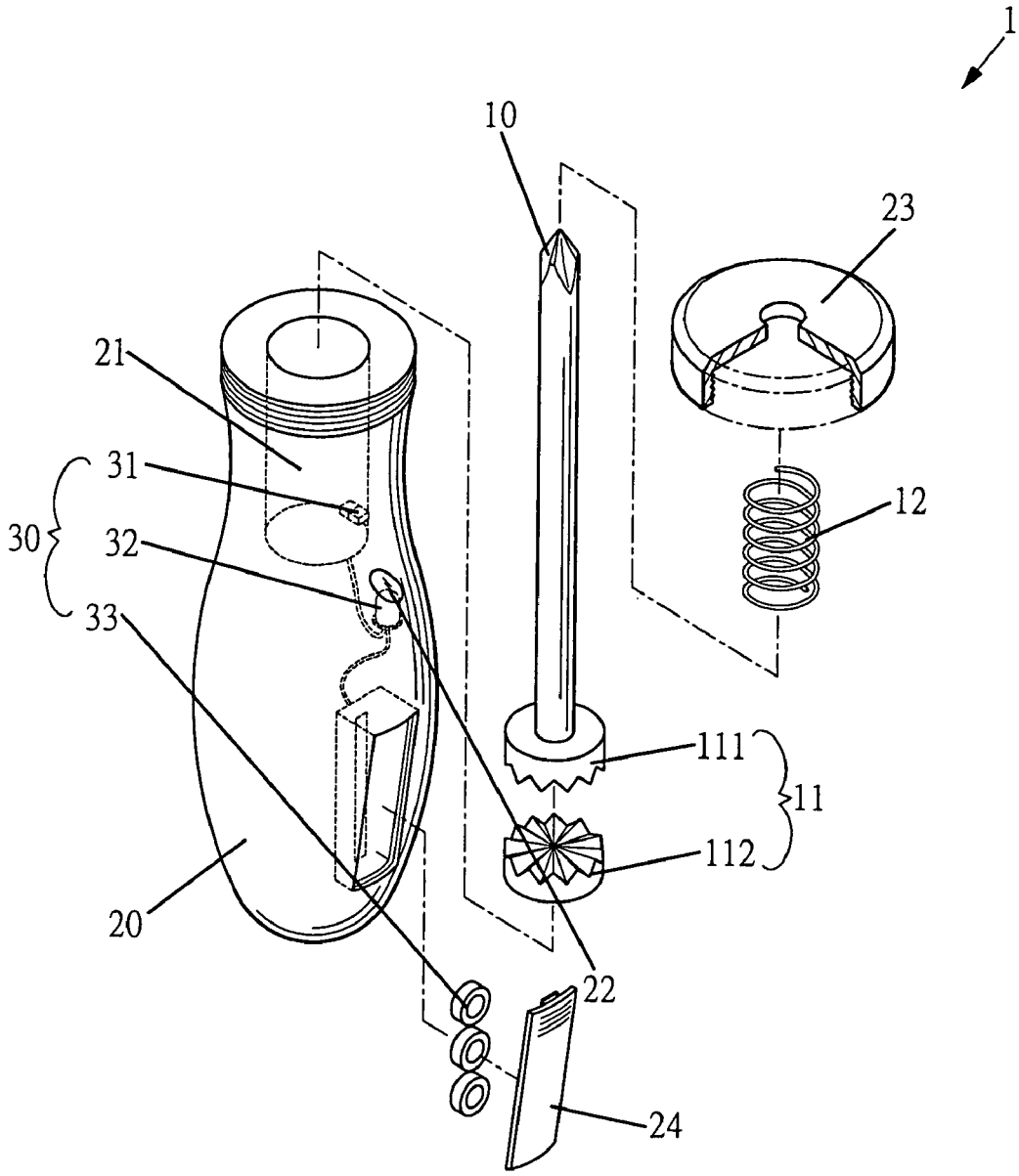
FIG. 1 is an exploded perspective view of the tension alert hand tool of the present invention.
Figure 2:
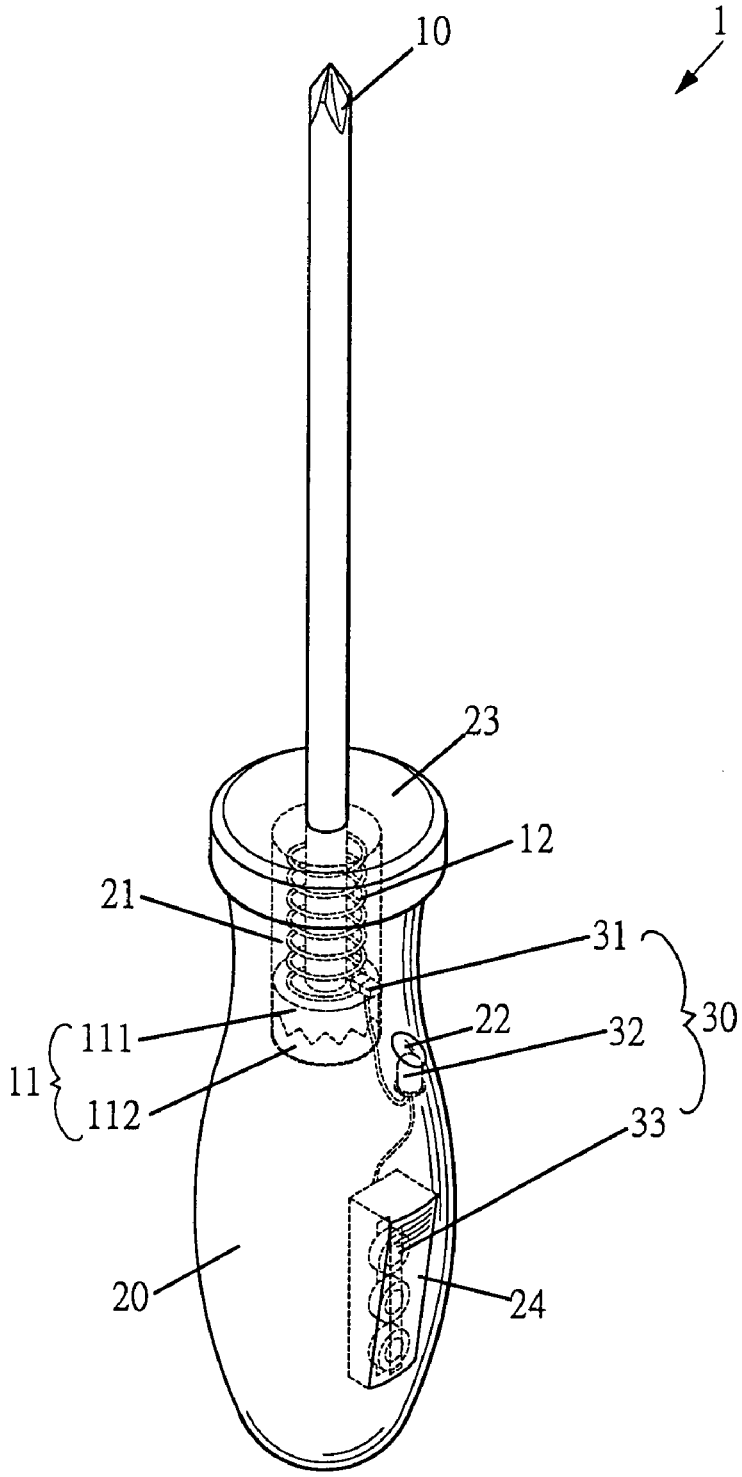
FIG. 2 is a perspective view of the tension alert hand tool of the present invention.

Referring to FIGS. 1 and 2, the structure of the present invention is illustrated. The present invention has the following elements.

A driving portion 10 has one end being an opening head. Another end of the driving portion 10 is formed as a buckling unit 11. The buckling unit 11 is formed by an upper teethed block 111 and a lower teethed block 112. The upper teethed block 111 is engageable to and bidirectionally moveable through the lower teethed block 112. An elastic unit 12 encloses the driving portion 10 and is installed above the buckling unit 11. In this embodiment, the elastic unit 12 is a spring.

The handle 20 is formed with a receiving groove 21 for receiving the buckling unit 11 and the elastic unit 12 of the driving portion 10 and a tension alarm device 30. A surface of the handle 20 is formed with a through hole 22 which is communicated to the handle 20. A cap 23 covers upon an upper opening of the receiving groove. The driving portion 10 passes through the cap 23. The cap 23 and the buckling unit 11 will compress the elastic unit 12. Another end of the handle 20 is installed with a cover 24.

The tension alarm device 30 includes a sensor switch 31, an alarm unit 32 and at least one battery 33. The battery 33 serves to supply power to the alarm unit 32 and the sensor switch 31. The sensor switch 31 is conducted to the alarm unit 32. The sensor switch 31 is installed in the receiving groove 21 of the handle 20 and is aside the upper teethed block 111 of the buckling unit 11. The alarm unit 32 is a bulb or a light emitting diode device. The alarm unit 32 is installed in the through hole 22 of the handle 20. The battery 33 is received in the handle 20. An outer side of the battery 33 is covered by the cover 24.

Figure 3:
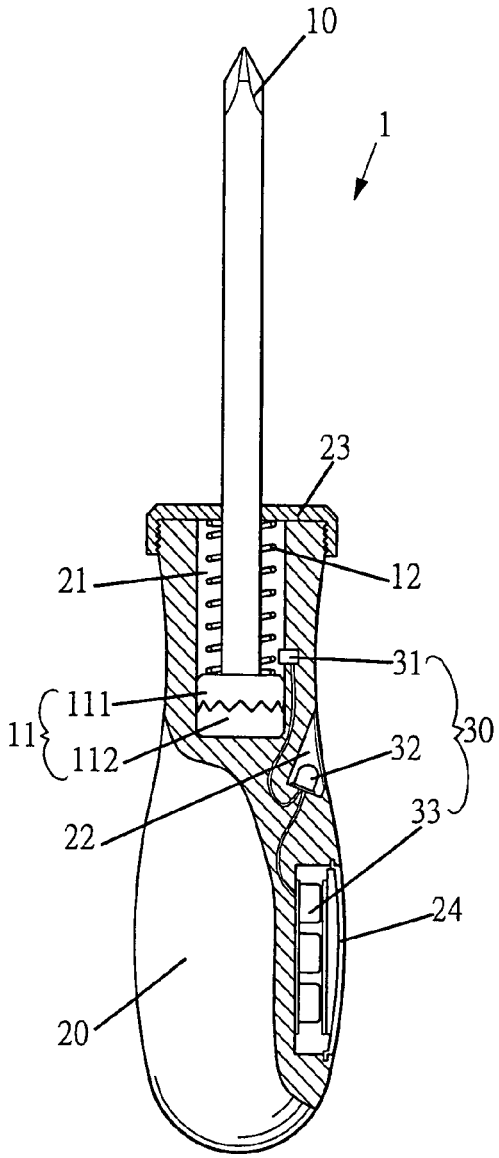
FIG. 3 is a schematic cross sectional view of the tension alert hand tool of the present invention.
Figure 4:
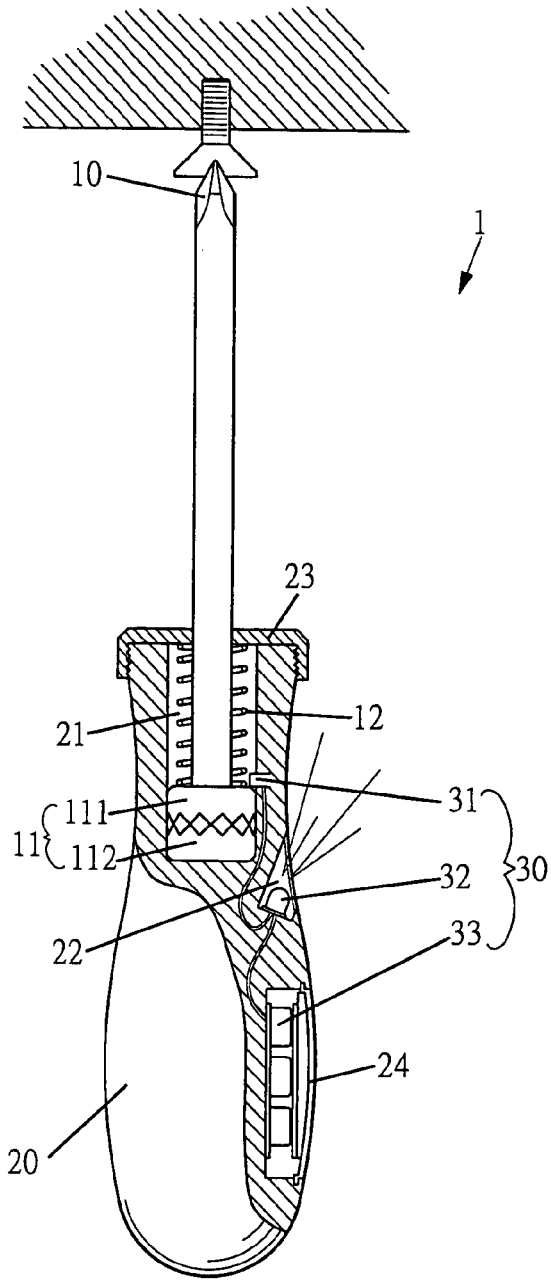
FIG. 4 is a schematic cross sectional view showing the operation of the present invention.

The effect of the present invention will be described herein with reference to FIGS. 3 and 4. When the opener of the present invention is used to screw an object so that the driving portion 10 rotates and the elastic unit 12 rotates therewith. When the twisting force to the screw unit has achieved to an upper limit value, the elastic unit 12 will release the engagement of the upper teethed block 111 and lower teethed block 112 so that the upper teethed block 111 will move through the lower teethed block 112. At this moment, the upper teethed block 111 will touch through the sensor switch 31 so as to actuate the alarm unit 32 to light up and thus to alert that the applied tension has achieve a predetermined value. When the upper teethed block 111 moves through the lower teethed block 112 continuously, the sensor switch 31 is touched continuously so that the alarm unit 32 flashes. Thus, even the user can not find the teeth collision between the teeth of the upper teethed block 111 and teeth of the lower teethed block 112, the flash will alert the user that the tension has been over the predetermined value so as to stop the operation.

Figure 5:
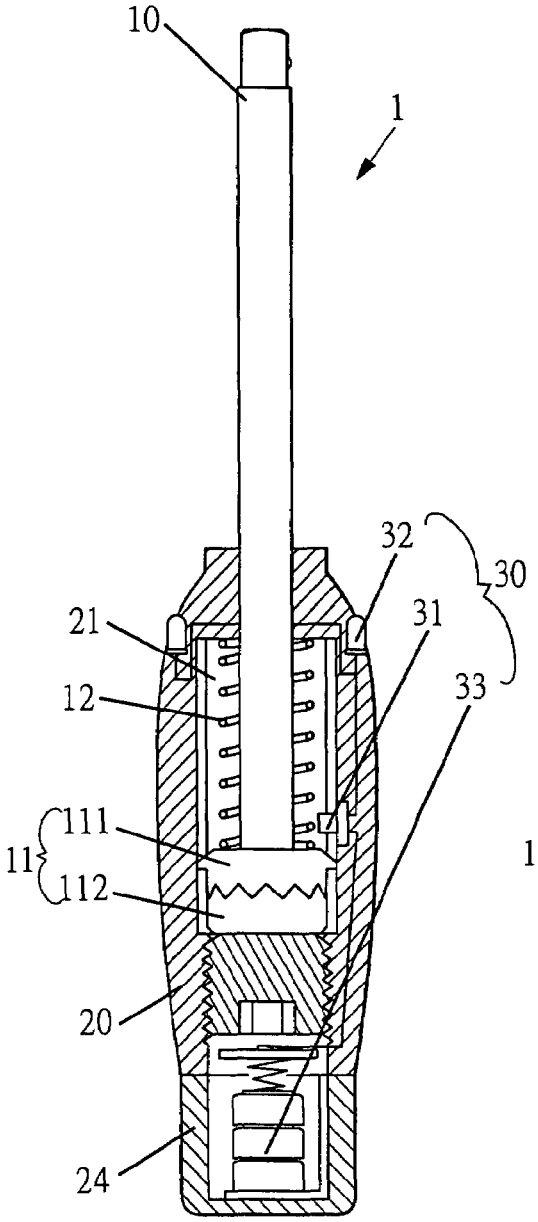
FIG. 5 is a schematic cross sectional view showing the second embodiment of the present invention.
Figure 6:
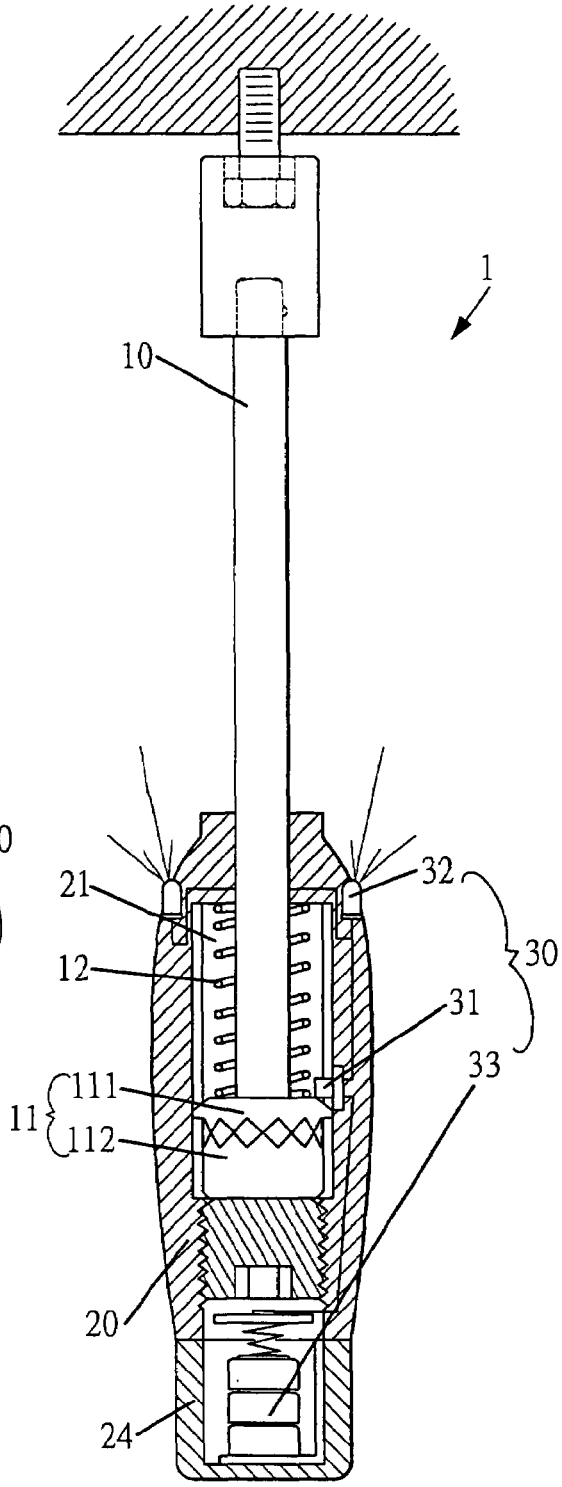
FIG. 6 is a schematic cross sectional view about the operation of the second embodiment of the present invention.

Referring to FIGS. 5 and 6, the second embodiment of the present invention is illustrated. In this embodiment, those identical to the above embodiment will not be further described herein. Only those different from above embodiment are described.

In this embodiment, the alarm unit 32 is installed at two upper sides of the handle 20 so that in operation, the user can still see the light from the alarm unit 32 without being shielded by the user's hand.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A tension alert hand tool, comprising:

a driving portion having one end being an opening head; another end of the driving portion being formed as a buckling unit; the buckling unit being formed by an upper teethed block and a lower teethed block; the upper teethed block being engageable to and bidirectionally moveable through the lower teethed block; an elastic unit enclosing the driving portion and being installed above the buckling unit;

a handle being formed with a receiving groove for receiving the buckling unit and the elastic unit of the driving portion and a tension alarm device; a lateral side of the handle being formed with a through hole which is communicated to the handle; a cap covering upon an upper opening of the receiving groove; the driving portion passing through the cap; the cap and the buckling unit will compress the elastic unit; a lateral side of the handle being formed with a recess and a cover covering upon the recess; and the recess being communicated to the through hole; and the tension alarm device including a sensor switch, an alarm unit and at least one battery; the at least one battery serving to supply power to the alarm unit and the sensor switch; the sensor switch being conducted to the alarm unit; the sensor switch being installed in the receiving groove of the handle and being aside the upper teethed block of the buckling unit; the alarm unit being installed in the through hole of the handle; the battery being received the recess of the handle; and an outer side of the battery being covered by the cover.

2. The tension alert hand tool as claimed in claim 1, wherein the tool is an opener or a spanner.

3. The tension alert hand tool as claimed in claim 1, wherein the alarm unit is a bulb or a light emitting diode device.

4. A tension alert hand tool, comprising:

a driving portion having one end being an opening head; another end of the driving portion being formed as a buckling unit; the buckling unit being formed by an upper teethed block and a lower teethed block; the upper teethed block being engageable to and bidirectionally moveable through the lower teethed block; an elastic unit enclosing the driving portion and being installed above the buckling unit;

a handle being formed with a receiving groove for receiving the buckling unit and the elastic unit of the driving portion and a tension alarm device; an upper side surface of the handle being formed with two through holes which are communicated to the groove of handle; a cap covering upon an upper opening of the receiving groove; the driving portion passing through the cap; the cap and the buckling unit will compress the elastic unit; a bottom side of the handle being formed with a recess; a cover covering upon the recess; and the recess being communicated to the through hole; and the tension alarm device including a sensor switch, two alarm units and at least one battery; the battery serving to supply power to the alarm unit and the sensor switch; the sensor switch being conducted to the alarm units; the sensor switch being installed in the receiving groove of the handle and being aside the upper teethed block of the buckling unit; the alarm units being installed in the two through holes of the handle; the battery being received the recess of the handle; and an outer side of the battery being covered by the cover.

5. The tension alert hand tool as claimed in claim 4, wherein the tool is an opener or a spanner.

6. The tension alert hand tool as claimed in claim 4, wherein the alarm unit is a bulb or a light emitting diode device.

* * * * *